US007631695B2

(12) United States Patent
Schafer et al.

(10) Patent No.: US 7,631,695 B2
(45) Date of Patent: Dec. 15, 2009

(54) WELLBORE ZONAL ISOLATION SYSTEM AND METHOD

(75) Inventors: Laura Schafer, Kuala Lumpur (MY); John R. Whitsitt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/876,433

(22) Filed: Oct. 22, 2007

(65) Prior Publication Data

US 2009/0101364 A1 Apr. 23, 2009

(51) Int. Cl.
*E21B 33/13* (2006.01)

(52) U.S. Cl. ..... 166/300; 166/295; 166/135

(58) Field of Classification Search ..... 166/300, 166/387, 185, 179, 135, 295, 277; 277/322
See application file for complete search history.

(56) References Cited

U.S. PATENT DOCUMENTS

| | | | | |
|---|---|---|---|---|
| 3,587,736 | A * | 6/1971 | Brown | 166/187 |
| 4,083,406 | A * | 4/1978 | Metz | 166/286 |
| 4,279,306 | A * | 7/1981 | Weitz | 166/312 |
| 5,697,441 | A * | 12/1997 | Vercaemer et al. | 166/285 |
| 6,390,196 | B1 | 5/2002 | Montaron | |
| 6,817,415 | B2 | 11/2004 | Orban | |
| 6,935,432 | B2 * | 8/2005 | Nguyen | 166/387 |
| 7,063,164 | B2 | 6/2006 | Hilsman | |
| 7,096,954 | B2 | 8/2006 | Weng | |
| 7,219,762 | B2 | 5/2007 | James | |
| 7,228,912 | B2 | 6/2007 | Patel | |
| 7,228,915 | B2 | 6/2007 | Thomson | |
| 7,275,602 | B2 | 10/2007 | Green | |
| 7,283,060 | B2 | 10/2007 | Robinson | |
| 2005/0199401 | A1 * | 9/2005 | Patel et al. | 166/387 |
| 2007/0209797 | A1 * | 9/2007 | Brink et al. | 166/297 |

FOREIGN PATENT DOCUMENTS

| | | |
|---|---|---|
| WO | 03064814 A1 | 8/2003 |

* cited by examiner

*Primary Examiner*—David J Bagnell
*Assistant Examiner*—Cathleen R Hutchins
(74) *Attorney, Agent, or Firm*—James L. Kurka; Jeremy P. Welch; Robert Van Someren

(57) ABSTRACT

A method of completing a wellbore includes the steps of connecting an isolation tool to a conveyance, the isolation tool including a tubular base member having an internal bore and an outer housing forming a first chamber and a second chamber separated by a wall; the first chamber having a first inlet port in communication with the internal bore and a first outlet port formed through the housing; the second chamber having first inlet port in communication with the internal bore and a second outlet port formed through the housing; a first material disposed in the first chamber; and a second material disposed in the second chamber; running the conveyance into the wellbore, an annulus formed between the isolation tool and sidewall of the wellbore; and activating the isolation tool to form a barrier to fluid flow in the annulus.

8 Claims, 2 Drawing Sheets

WELLBORE ZONAL ISOLATION SYSTEM AND METHOD

FIELD OF THE INVENTION

The present invention relates in general to wellbore operations and more particularly to a system and method for forming annular barriers in wellbores.

BACKGROUND

In wellbore operations it is often desired or necessary to isolate one zone of the wellbore from one or more of the other zones traversed by the wellbore. For example, in production wells some of the zones may produce oil and/or gas, while others may produce excessive water. In injection wells it is often necessary to isolate the zones for injection.

Therefore is a desire to provide an invention for providing zonal isolation in wellbores and more particularly to forming annular barriers in wellbores.

SUMMARY OF THE INVENTION

In accordance with the present invention, an apparatus, system and method are provided for forming an annular barrier to fluid flow. In one aspect of the present invention a method of completing a wellbore includes the steps of connecting an isolation tool to a conveyance, the isolation tool including a tubular base member having an internal bore and an outer housing forming a first chamber and a second chamber separated by a wall; the first chamber having a first inlet port in communication with the internal bore and a first outlet port formed through the housing; the second chamber having first inlet port in communication with the internal bore and a second outlet port formed through the housing; a first material disposed in the first chamber; and a second material disposed in the second chamber; running the conveyance into the wellbore, an annulus formed between the isolation tool and sidewall of the wellbore; and activating the isolation tool to form a barrier to fluid flow in the annulus.

The foregoing has outlined the features and technical advantages of the present invention in order that the detailed description of the invention that follows may be better understood Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
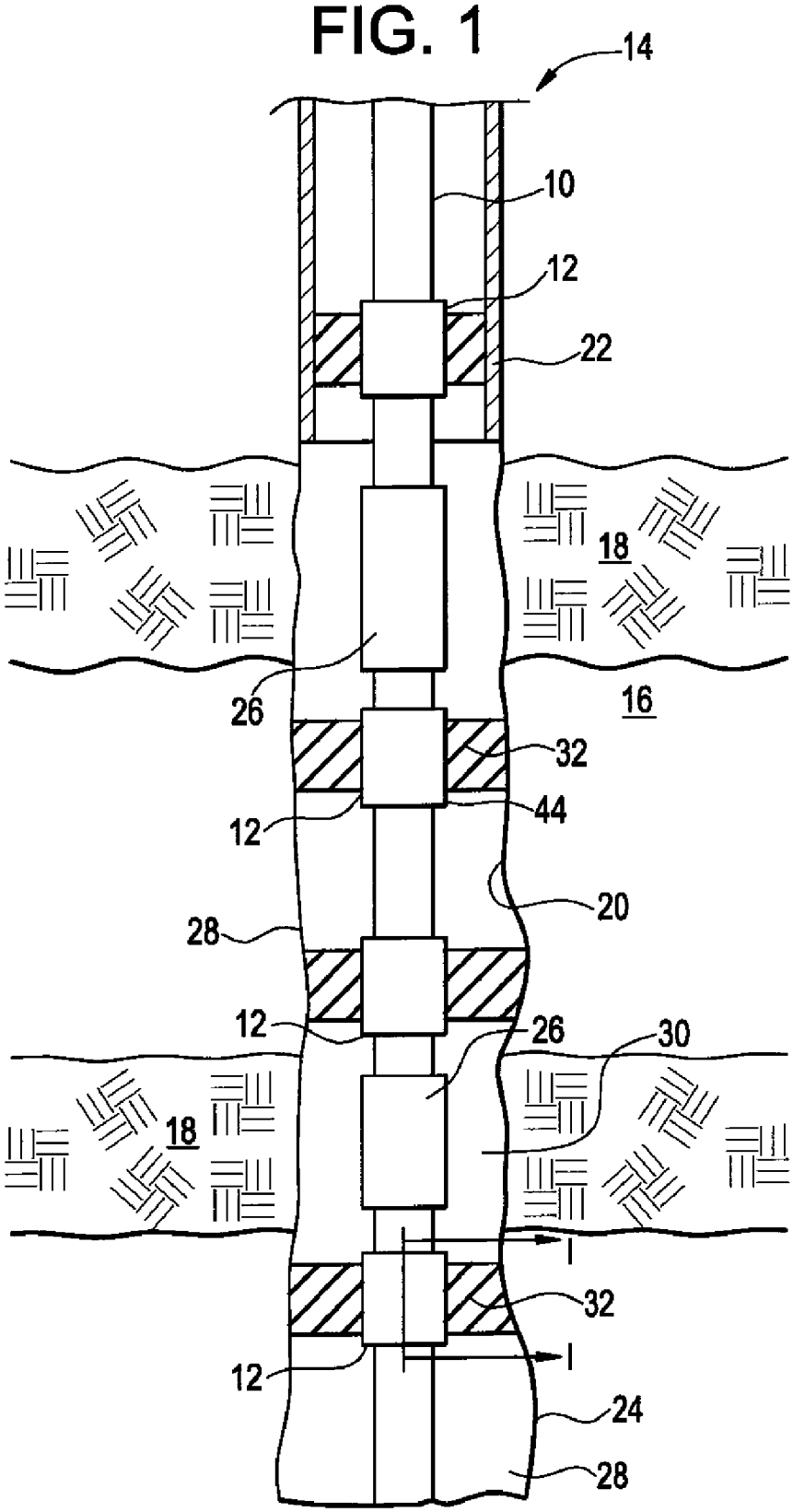
FIG. 1 is a schematic of a wellbore incorporating a wellbore zonal isolation system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Referring now to FIG. 1, a conveyance 10 carrying a zonal isolation tool 12 is positioned within a well 14. Conveyance 10 may include tubulars such as jointed tubing, coiled tubing and the like. Well 14 penetrates the subterranean formation 16 and one or more zones of interest 18. Well 14 may include a cased portion wherein the sidewall 20 of the wellbore is supported by casing 22 and an open-hole portion 24. The present invention will be described for utilization in the open-hole portion, although the invention may be utilized in the cased or open-hole portion.

Tubing string 10 may carry isolation tool 12 singularly or in combination with other completion tools 26 such as packers, valves, cross-over assemblies, screens, slotted liners, etc. In FIG. 1, isolation tool 12 is carried in conjunction with screen assemblies 26 as part of a sand control completion.

The outer surface 44 of the tubing string 10 and the carried tools and sidewall 20 of the wellbore form an annulus 28. In the illustrated embodiment, a portion of annulus 28 is filled with gravel 30 or other material such as in a gravel-pack completion.

Isolation tool 12 is provided to position an annular barrier 32 in well 14. In FIG. 1, an aspect of the invention is illustrated in which annular barriers 32 are position on each side of the zones of interest 18 to provide zonal isolation. Annular barrier 32 is formed of a material to substantially seal against fluid passage between isolation tool 12 or the tool string and sidewall 20 of the wellbore. In aspects of the present invention, annular barrier 32 is formed by the mixture of two or more materials.

Figure 2A:
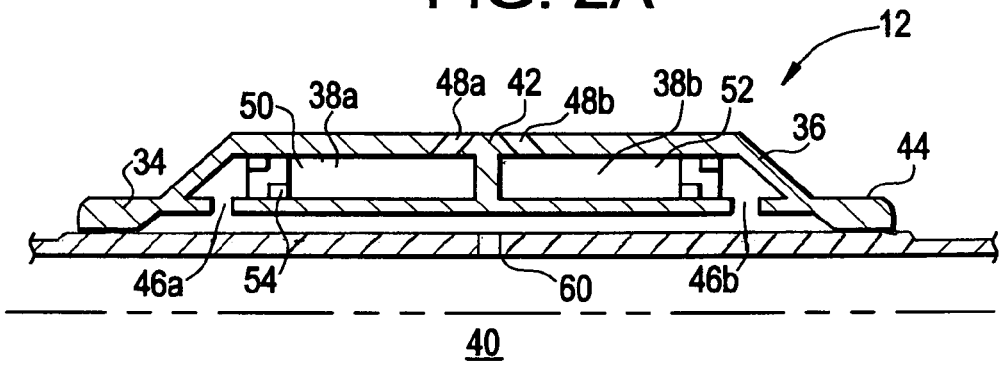
FIG. 2A is a cross-sectional view of the isolation tool, along the line I-I of FIG. 1, shown in the run-in position.
Figure 2B:
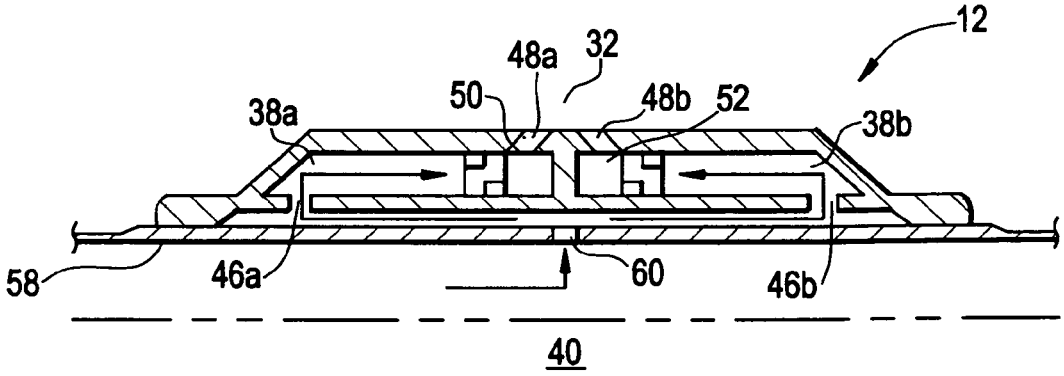
FIG. 2B is a cross-sectional view of the isolation tool, along the line I-I of FIG. 1, shown in the actuated position for forming an annular barrier.

Referring now to FIGS. 2A and 2B, wherein cross-sectional views of isolation tool 12 along the line I-I of FIG. 1 are provided. FIG. 2A illustrates isolation tool 12 in the run-in position. FIG. 2B illustrates isolation tool 12 in the actuated position, placing and forming annular barrier 32.

Isolation tool 12 includes a base member 34, housing 36, and a pair of chambers 38. Each chamber 38 has an inlet port 46 and an outlet port 48. Each chamber 38 contains a material that is reactant with the material in the other chamber so as to form annular barrier 32 when mixed. A piston 54 is disposed in each chamber for discharging the reactant material upon actuation to form annular barrier 32.

Base member 34 is a tubular member having an internal diameter defining an internal bore 40. Housing 36 extends over a portion of base member 34 to form a first chamber 38*a* separated from a second chamber 38*b* by wall 42. Polished bores 56 may be provided on each end of tool 12.

Inlet ports 46*a*, 46*b* are formed through base member 34 into chambers 38*a*, 38*b* respectively. An outlet port 48*a* is formed from chamber 38*a* through housing 36 to annulus 28 (FIG. 1). Outlet port 48*b* is formed from chamber 38*a* through housing 36 to annulus 28 (FIG. 1).

First chamber 38*a* includes a first material 50 and second chamber 38*b* contains a second material 52. A piston 54 is positioned within each chamber 38 for discharging materials 50, 52 from their respective chambers through outlet ports 48*a*, 48*b*. Outlet ports 48*a* and 48*b* are oriented so as to discharge the contents of the chambers to a common point for mixing and forming annular barrier 32.

In the run-in position, as shown in FIG. 2A, a sleeve or other tubular may be positioned within internal bore 40 to cover inlet ports 46*a*, 46*b*. For actuation, as shown in FIG. 2B, an activation tool 58 is positioned within tool 12.

Operation of tool 12 is now described with reference to the Figures. Isolation tool 12 is run into well 14 on conveyance 10, positioning tool 12 at the desired location for placement of annular barrier 32 An activation tool 58, such as a washpipe with straddle packers, is disposed in internal bore 40 and set in tool 12. Fluid, such as drilling mud, is pumped through internal bore 40, through the port 60 of activation tool 58, and through inlet ports 46*a*, 46*b* into chambers 38*a*, 38*b* as shown by the arrows. The fluid pressure acts on pistons 54 discharging material 50 through outlet port 48*a* and material 52 through outlet port 48*b*. Outlet ports 48 discharge materials 50, 52 at approximately the same location causing contact of and/or mixture of materials 50, 52 so as to form annular barrier 32.

Various materials 50, 52 may be utilized to form annular barrier 32. Annular barrier 32 may be formed of various materials depending on the characteristics necessary for the well application. For example, materials 50 and 52 must be suitable for injecting through outlet ports 48 and for setting into a sealing annular barrier 32. Thus, the mixture desirably will set and become substantially self-supporting relatively quickly. It may be desired for the mixture forming annular barrier 32 be a swellable material. Examples of suitable annular barrier 32 material include, without limitation, foamed cements; unfoamed cements, polymers such as epoxy, and cross-linking polymers.

Examples of suitable combinations of a first material 50 and second triggering material 52 to form a swellable annular barrier 32 include, without limitation: ethylene-propylene-copolymer rubber (hydrocarbon oil); ethylene-propylene-diene terpolymer rubber (hydrocarbon oil); butyl rubber (hydrocarbon oil); haloginated butyl rubber (hydrocarbon oil); brominated butyl rubber (hydrocarbon oil); chlorinated butyl rubber (hydrocarbon oil); chlorinated polyethylene (hydrocarbon oil); starch-polyacrylate acid graft copolymer (water); polyvinyl alcohol cyclic acid anhydride graft copolymer (water); isobutylene maleic anhydride (water); acrylic acid type polymers (water); vinylacetate-acrylate copolymer (water), polyethylene oxide polymers (water); carboxymethyl celluclose type polymers (water); starch-polyacrylonitrile graft copolymers (water); highly swelling clay minerals, i.e. sodium bentonite, (water); styrene butadiene (hydrocarbon); ethylene propylene monomer rubber (hydrocarbon), natural rubber (hydrocarbon); ethylene propylene diene monomer rubber (hydrocarbon); ethylene vinyl acetate rubber (hydrocarbon); hydrogenised acrylonitrile-butadiene rubber (hydrocarbon); acrylonitrile butadiene rubber (hydrocarbon); isoprene rubber (hydrocarbon); chloroprene rubber (hydrocarbon); and polynorbornene (hydrocarbon).

Although not illustrated in the Figures, it should be noted that isolation tool 12 may include a single chamber for carrying a first material 50. Upon discharge from isolation tool 12, first material 50 may mix with a second material 52 already position in annulus 28. This aspect of the invention is adapted in particular for utilization with gravel-pack 30.

From the foregoing detailed description of specific embodiments of the invention, it should be apparent that a system for providing zonal isolation in a wellbore that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An apparatus for creating a barrier to fluid flow in an annulus formed between a tubular string and a wellbore, the apparatus comprising:

a first chamber formed between a tubular base member having an internal bore and an outer housing;

a first inlet port formed by the base member between the internal bore and the first chamber;

a first outlet port formed through the outer housing from the first chamber; and a reactive material disposed in the first chamber, wherein the reactive material is selectively forced through the first outlet port to undergo a chemical reaction that forms a barrier material around the outer housing.

2. The apparatus of claim 1, further including a piston positioned in the first chamber.

3. The apparatus of claim 1, further including a second chamber formed between the base member and the outer housing, the second chamber including a second inlet port formed through the base member and a second outlet port formed through the housing.

4. The apparatus of claim 3, further including a first piston positioned in the first chamber and a second piston positioned in the second chamber.

5. A method of completing a wellbore that penetrates a subterranean formation having a zone of interest, the method comprising the steps of:

connecting at least one isolation tool to a conveyance, the isolation tool including a tubular base member having an internal bore, an outer housing, a first chamber and a second chamber formed between the outer housing and the tubular base member and separated by a wall; the first chamber having a first inlet port in communication with the internal bore across the tubular base member and a first outlet port formed through the housing; the second chamber having a second inlet port in communication with the internal bore across the tubular base member and a second outlet port formed through the housing; a first material disposed in the first chamber; and a second material disposed in the second chamber, the first material being reactant with the second material to form a barrier material;

running the conveyance into the wellbore, an annulus formed between the isolation tool and sidewall of the wellbore; and activating the isolation tool to cause the first material to flow into contact with and react with the second material to form a barrier to fluid flow in the annulus.

6. The method of claim 5, wherein the isolation tool further includes a first piston positioned in the first chamber and a second piston positioned in the second chamber.

7. A method of completing a wellbore that penetrates a subterranean formation having a zone of interest, the method comprising the steps of:

connecting at least one isolation tool to a conveyance, the isolation tool including a tubular base member having an internal bore, an outer housing, a first chamber and a second chamber formed between the outer housing and the tubular base member and separated by a wall; the first chamber having a first inlet port in communication with the internal bore across the tubular base member and a first outlet port formed through the housing; the second chamber having a second inlet port in communication with the internal bore across the tubular base member and a second outlet port formed through the housing; a first material disposed in the first chamber; and a second material disposed in the second chamber;

running the conveyance into the wellbore, an annulus formed between the isolation tool and sidewall of the wellbore; and activating the isolation tool to form a barrier to fluid flow in the annulus, wherein gravel is positioned in the annulus before activating the isolation tool.

8. The method of claim 5, wherein the first outlet port and the second outlet port are positioned to discharge the first and the second materials at a common location in the annulus.

* * * * *